US005511325A

United States Patent [19]

Hieblinger

[11] Patent Number: 5,511,325

[45] Date of Patent: Apr. 30, 1996

[54] SHOE WITH A HEEL-MOUNTED CENTRAL ROTARY CLOSURE

[75] Inventor: Rudolf Hieblinger, München, Germany

[73] Assignee: Puma AG, Germany

[21] Appl. No.: 249,357

[22] Filed: May 27, 1994

[30] Foreign Application Priority Data

May 28, 1993 [DE] Germany ..... 9308037 U

[51] Int. Cl.[6] ..... A43B 11/00

[52] U.S. Cl. ..... 36/50.1; 36/105

[58] Field of Search ..... 36/50.1, 114, 50.5, 36/54, 117–121, 88, 89, 105, 51; 24/68 SK, 68 B, 712.5

[56] References Cited

U.S. PATENT DOCUMENTS

| | | | |
|---|---|---|---|
| 536,345 | 3/1895 | Harris | 36/51 |
| 4,937,953 | 7/1990 | Walkoff | 36/119 |
| 5,117,567 | 6/1992 | Berger . | |
| 5,177,882 | 1/1993 | Berger . | |
| 5,181,331 | 1/1993 | Berger . | |
| 5,325,613 | 7/1994 | Sussman | 36/50.5 |
| 5,341,583 | 8/1994 | Hallenbeck | 36/50.1 |

FOREIGN PATENT DOCUMENTS 0247487 12/1987 European Pat. Off. .

*Primary Examiner*—Thomas P. Hilliard
*Attorney, Agent, or Firm*—Sixbey, Friedman, Leedom & Ferguson; David S. Safran

[57] ABSTRACT

A shoe having a central rotary closure arranged on the heel of the upper in the area above the location at which the heel bone is received and having at least one tightening element which has a tightening section running from the central rotary closure towards each side of the shoe. The tightening sections are coupled by a coupling element with at least one strap which runs from each tightening section or coupling element over the instep or/and by the arch to the other tightening section or coupling element. Furthermore, strap sections span the instep area between locations at which the wearer's ankle and metatarsophalangeal joints are received, these sections crossing each other as they span the instep area, and are fastened at a frontal portion of a respective side of the shoe opposite that at which it is coupled to a respective tightening section.

16 Claims, 2 Drawing Sheets

SHOE WITH A HEEL-MOUNTED CENTRAL ROTARY CLOSURE

BACKGROUND OF THE INVENTION

1. Field of the Invention

This invention relates to a shoe, particularly an athletic shoe, having an upper formed of flexible materials, which is opened and closed by a central rotary closure to which at least one tightening element is coupled, the tightening element being guided over guide elements on the shoe instead of using conventional laces passed through eyelets or about hooks.

2. Description of Related Art

Shoes of the type to which the present invention is directed are known, for example, from U.S. Pat. Nos. 5,117,567 and 5,181,331. In the shoes described there, the central rotary closure is attached to an instep cover, to which lateral closing flaps, for side parts of the upper, are molded-on in a hinged manner. The tightening element that can be tightened with the central rotary closure runs from the instep cover alternately over guide elements of the closing flaps and the instep cover.

Further, it is known from one embodiment of the previously mentioned patents and from U.S. Pat. 5,177,882 to make the closing flaps as separate parts from the instep cover. In this case, the guide elements are attached to lateral straps which run over the shoe upper to the area of the shoe sole and which connect to the closing flaps via corresponding recesses formed in the closing flaps.

Also, allowed, co-pending U.S. patent application Ser. No. 08/064,644, filed May 21, 1993, describes a shoe having a central closure which is mounted on the upper in the vicinity of the ankle bone area thereof. In this case, the tightening element runs from the central closure to guide elements on instep cover and then runs alternately over guide elements of the closing flaps and the instep cover.

Such known shoes with a central rotary closure can be put on and pulled off quickly. Nevertheless, the closing action can be adjusted simply, quickly and individually.

SUMMARY OF THE INVENTION

With this invention, the object to be achieved is to configure the closing mechanism of shoes of the above-mentioned type so that they can be produced and assembled economically while assuring that good foot support in the shoe is obtained. At the same time, the arrangement is to be made so that an accidental opening of the central rotary closure and thus of the shoe in the case of stress on the instep, for example, by the impact of a ball or the like, is avoided.

This object is achieved in accordance with a preferred embodiment of the invention by having the central rotary closure arranged on the heel of the upper in the area above the location at which the heel bone is received and having at least one tightening element which has a tightening section running from the central rotary closure towards each side of the shoe. The tightening sections are coupled by a coupling element with at least one strap which runs from each tightening section or coupling element over the instep or/and by the arch to the other tightening section or coupling element.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENT

Figure 1:
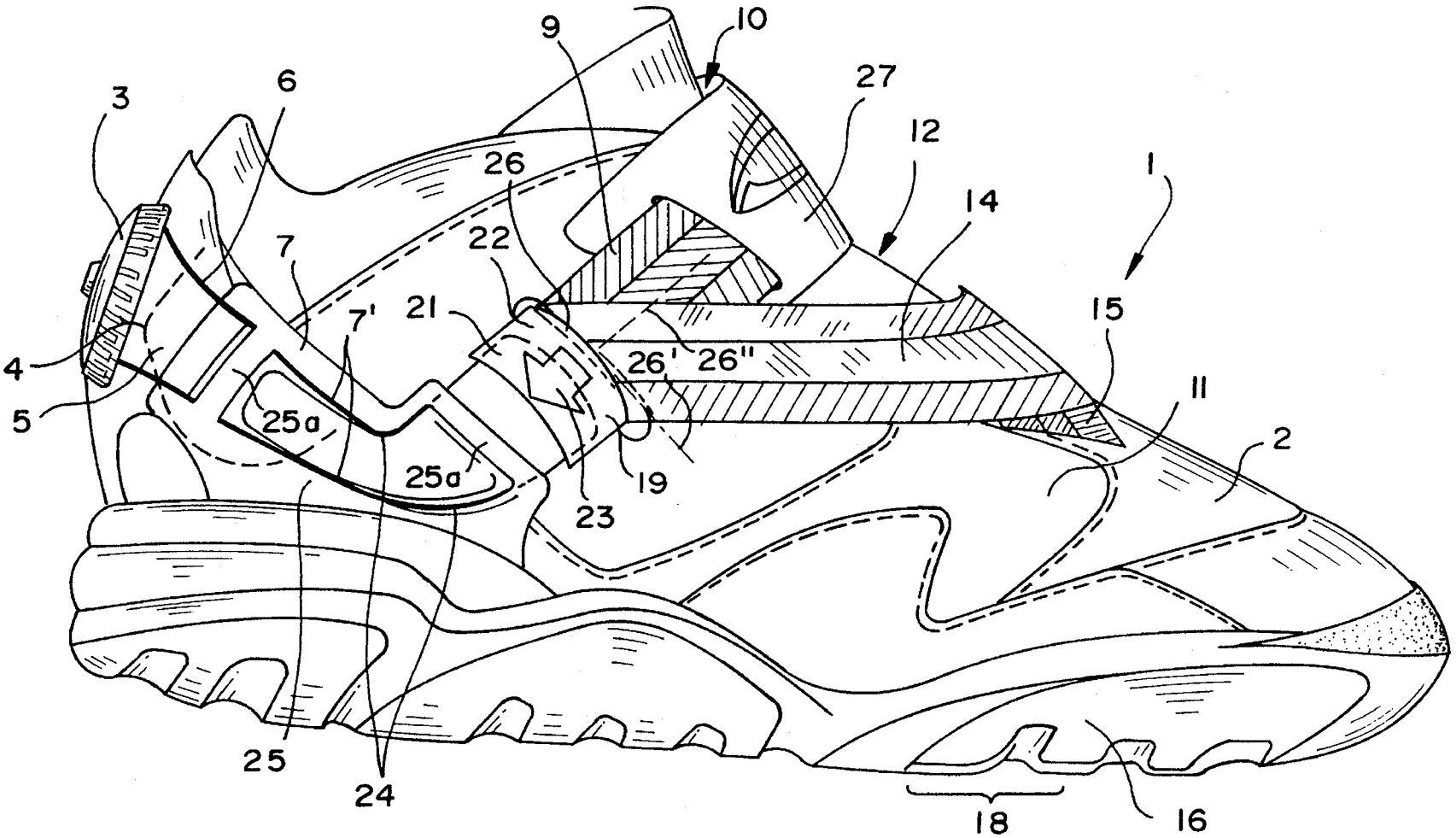
FIG. 1 is a side view of a shoe according to the invention.

A shoe 1, especially a sport or leisure shoe, has an upper 2 which is formed of elastically flexible materials, the illustrated example being a shoe of the type used, e.g., for playing tennis. On the rear end of the upper 2, a central rotary closure 3 is arranged in an area above that at which a rear edge 4 of a wearer's heel bone 5 (represented by a broken line) is received. Central rotary closure 3 can be fastened to the rear end of upper 2 either directly or by an intermediate support, for example, an external heel counter. Also, the central rotary closure 3 can be of any known design and preferably is provided with a quick release device, by which a quick releasing of the holding force on tightening element can be obtained by pulling or pressing on its winding knob.

A tightening element 6, for example, a plastic or wire rope, is coupled with central rotary closure 3, in a way known in the art, so that its free length can be shortened to close the shoe and lengthened to open it by rotating the central rotary closure 3. A quick release can take place by pulling or pressing on the closure.

Tightening element 6 has a tightening section 7, 8, especially in the form of a loop 7', 8' that is guided forwardly along each side of the upper. The tightening sections 7, 8 are coupled to a strap 9, which runs in the vicinity of ankle 10 from lateral (outer) side 11 of the shoe (i.e., the side at which the lateral malleolus of the foot is located), crosswise over the instep 122 to the medial (inner) side 13 of the shoe (i.e., the side at which the inner malleolus of the foot is located).

Further, tightening sections 7, 8 are coupled on each side 11, 13 of the shoe with a respective strap section 14 or 15, which runs from side 11 or 13 of the shoe, forward over instep 12 to the opposite side 13 or 11 of the shoe, crossing over instep 12 en route. At the opposite side, the end of the respective strap section 14, 15 is fastened to the upper 2, to a special fitting or to the sole 16. Fastening points 17 (FIG. 2) are located in the from section of the vamp in an area 18 of the metatarsophalangeal joints of the foot, between them and the ankle 10.

The connection between tightening sections 7 or 8, strap 9 and strap sections 14 or 15 takes place either directly or by a respective coupling element 19, 20. For this purpose, coupling elements 19, 20, for example, respectively, have a deflecting element 21, especially in the form of a guideway, for example, having a guiding groove 22 running thereabout in a semi-circular or elliptical path, or other suitable way. Tightening sections 7 or 8 are guided in this guiding groove 22. In the design of tightening sections 7, 8 as loops 7' or 8', the loops are hooked over the deflecting element 21 into the guiding groove 22.

Preferably, each coupling element 19, 20 has a deflecting element 26, for example in the form of a pin or bar, around which strap 9 is guided and from which the thus formed strap sections 14, 15 pass to the fastening points 17 at which they are attached to shoe 1. Strap 9 and strap sections 14, 15 consist in this case of a single tape, so that special fastenings to coupling elements 19 or 20 are eliminated. Furthermore, the tape can slide around deflecting elements 26, so that the length of strap 9 and strap sections 14, 15 thereof can be accordingly adjust to the shape of the foot.

In an advantageous way, the longitudinal axis 26' of bar-shaped deflecting element 26 of coupling elements 19, 20 runs perpendicular to the direction of the tensile stress occurring in strap 9, indicated by arrow 23, when the tightening element is wound in by the rotary central closure 3. However, the bar-shaped deflecting element 26 can also be arranged so that perpendicular line 26" lies at an angle area α (FIG. 2) to longitudinal axis 26' that is less than a right angle, so as to lie within the angle defined between the represented pull direction of strap 9 (arrow 23) and the direction of the tensile stress occurring in respective strap section 14 or 15 (arrow 28, FIG. 2). In particular, deflecting element 26 can be arranged so that perpendicular line 26" runs in or approximately in the direction of the bisector of angle α of the pull directions indicated by arrows 23 and 28.

By rotating central rotary closure 3 in the direction winding the tightening element 6 to shorten its free length, coupling elements 19, 20 are pulled in the direction of arrow 23 and in doing so, strap 9 and strap sections 14, 15 are pulled in a closing direction.

Figure 2:
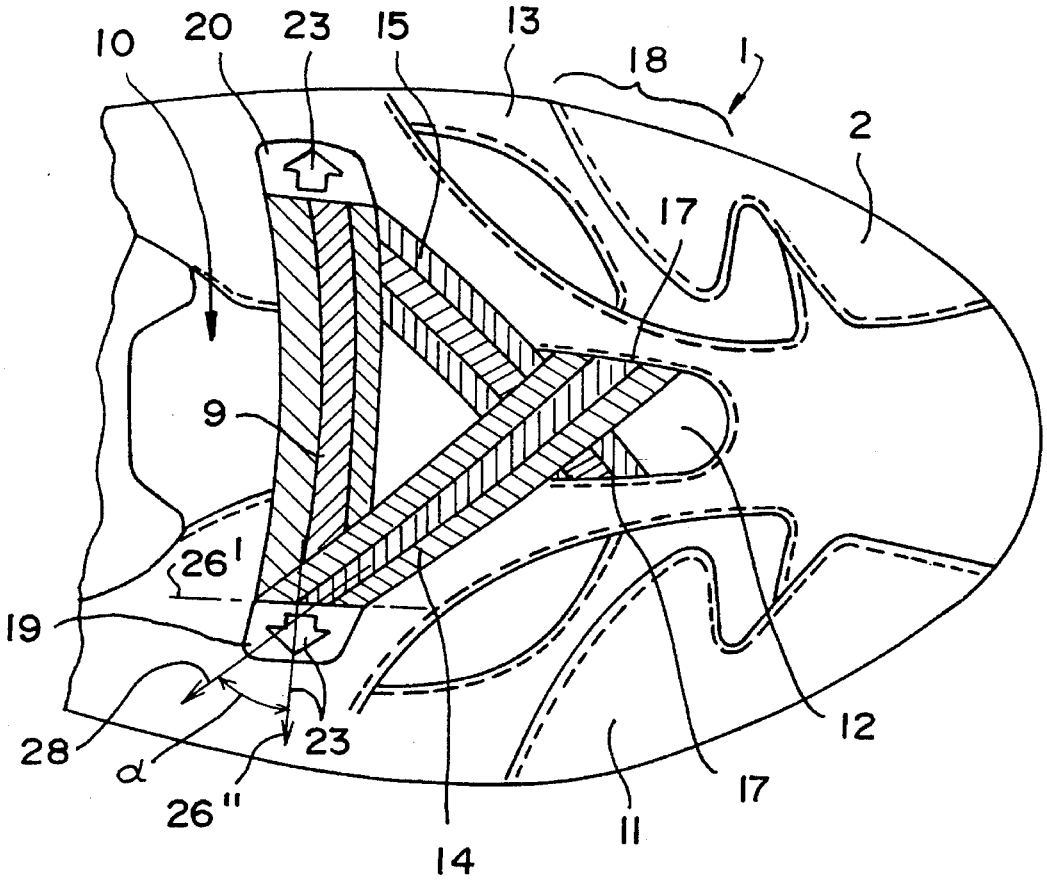
FIG. 2 is a top view of the front part (vamp) of the shoe.
Figure 3:
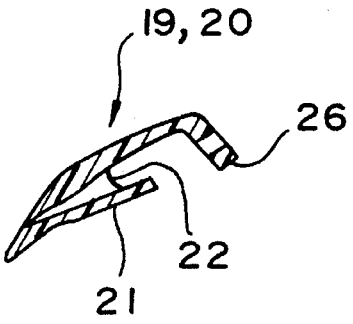
FIG. 3 is a longitudinal vertical cross section of a coupling element.
Figure 4:
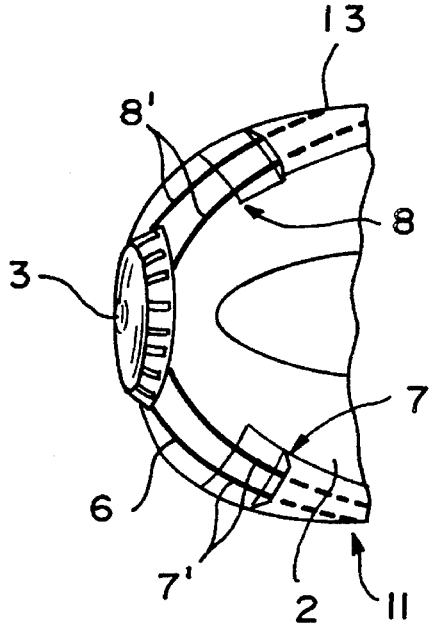
FIG. 4 is a top view of the rear heel section of the shoe.

To achieve a pull direction that is downward and preferably simultaneously rearward (arrow 23 in FIG. 1 ), tightening sections 7, 8 are guided from the central rotary closure 3 by deflecting means 24, first downward and forward, and then forward and upward in the area below the malleolus to the area where each is coupled with a respective coupling element 19 or 20 (FIG. 2).

To guide tightening sections 7 or 8, deflecting means 24 is formed as guide grooves in a respective guide plate 25 that is attached to each side 11, 13 of the shoe. The tightening sections 7, 8 enter and leave the guide grooves forming deflecting means 24 by passing under transverse guide bars **25*a* which serve to hold the tightening sections 7, 8 in the open grooves. Guide plates 25 are preferably formed of a hard flexible material having good sliding properties for tightening element 6**, such as a polyethylene, polyamide, polyimide or the like.

A pressure-distributing element 27 can be connected with at least the portion of strap 9 spanning the instep 12 near ankle 10. The pressure-distributing element is used to transfer the tightening pressure exerted on instep 12 during tightening to a larger area and thus to reduce the load per area unit. It consists, for example, of a pressure-distributing plate, through which strap 9 passes.

Strap 9 and strap sections 14, 15 preferably are formed of a woven fabric tape, whose ratio of thickness to width is about 1:5 to 1:50, especially about 1:15 to 1:30.

While only a single embodiment in accordance with the present invention has been shown and described, it should be understood that the invention is not limited thereto, and is susceptible to numerous changes and modifications as will be known to those skilled in the art. Therefore, this invention is not limited to the details shown and described herein, and includes all such changes and modifications as are encompassed by the scope of the appended claims.

I claim:

1. Shoe having an upper, formed of a flexible material, which is opened and closed by a central rotary closure to which at least one tightening element is coupled, the at least one tightening element being guided over guide elements on the shoe; wherein the central rotary closure is arranged on a heel portion of the upper in an area above a location at which a heel bone of a wearer is received; wherein the at least one tightening element has a tightening section running from the central rotary closure around each side of the heel portion of the shoe and being coupled at each side of the upper with at least one strap which runs over an instep area of the upper between the tightening sections; wherein the at least one strap has sections which span the instep area between locations at which a wearer's and metatarsophalangeal joints are received, said sections crossing each other as they span the instep area, each being fastened at a frontal portion of a respective side of the shoe opposite that at which it is coupled to a respective tightening section.

2. Shoe according to claim 1, wherein the tightening element runs first downward and forward from the central rotary closure on both sides of the heel portion of the upper and is then deflected upward and forward in an area of the upper below which the respective malleolus of the wearer is received.

3. Shoe according to claim 1, wherein said at least one strap spans the instep area of the upper in the vicinity of a location where a wearer's ankle is received.

4. Shoe according to claim 1, wherein each tightening section is coupled to the at least one strap by a coupling element, each coupling element comprising deflecting elements over which the respective tightening section is looped.

5. Shoe according to claim 4, wherein each coupling element further comprises a deflecting bar, around which said at least one strap is guided.

6. Shoe according to claim 5, wherein the deflecting bar has a longitudinal axis which runs approximately perpendicular to a direction of tensile stress occurring in said at least one strap where it passes over instep area of the upper in the vicinity of the location where the wearer's ankle is received.

7. Shoe according to claim 5, wherein the deflecting bar has a longitudinal axis which runs along an angular area defined between a direction of tensile stressing of the at least one strap as it crosses over the instep area in the vicinity of the location where the wearer's ankle is received and a direction of tensile stressing in strap sections crossing over the instep area between locations at which a wearer's ankle and metatarsophalangeal joints are received applied by said tightening sections to said at least one strap.

8. Shoe according to claim 7, wherein the longitudinal axis of the deflecting bar runs approximately along a bisector of said angular area.

9. Shoe according to claim 5, wherein said at least one strap is a single strap spanning the instep area of the upper in the vicinity of a location where a wearer's ankle is received and after being guided around the deflecting bars of the coupling elements has sections which span the instep area between locations at which a wearer's ankle and metatarsophalangeal joints are received, said sections crossing each other as they span the instep area, the sections being fastened at a frontal portion of a respective side of the shoe opposite that at which it is coupled to a respective tightening section.

10. Shoe according to claim 1, wherein a guide plate made of hard flexible plastic having low friction properties is arranged on each side of the heel portion.

11. Shoe according to claim 10, wherein each guide plate has deflecting means by which the tightening section is deflected from a forward and down direction to a forward and up direction.

12. Shoe according to claim 1, wherein said at least strap spanning the instep area is provided with a pressure-distributing element for providing an increased tightening pressure application area over which tightening pressure applied by said at least one strap is transmitted to the wearer.

13. Shoe according to claim 1, wherein said at least one strap is formed of a woven fabric tape.

14. Shoe according to claim 13, wherein a ratio of thickness to width of said woven fabric tape is about 1:5 to 1:50.

15. Shoe according to claim 14, wherein said ratio of thickness to width of said woven fabric tape is about 1:15 to 1:30.

16. Shoe according to claim 1, wherein said central rotary closure is of the quick release type.

* * * * *